United States Patent [19]

Campbell

[11] 3,990,232

[45] Nov. 9, 1976

[54] COMBUSTOR DOME ASSEMBLY HAVING IMPROVED COOLING MEANS

[75] Inventor: Thomas C. Campbell, Cincinnati, Ohio

[73] Assignee: General Electric Company, Cincinnati, Ohio

[22] Filed: Dec. 11, 1975

[21] Appl. No.: 639,617

[52] U.S. Cl. ..... 60/39.66

[51] Int. Cl.[2] ..... F02C 7/18

[58] Field of Search..... 60/39.65, 39.66, 39.69

[56] References Cited

UNITED STATES PATENTS

| | | | |
|---|---|---|---|
| 2,709,338 | 5/1955 | Morley et al. | 60/39.32 |
| 3,134,229 | 5/1964 | Johnson | 60/39.65 |
| 3,385,055 | 5/1968 | Koblish et al. | 60/39.66 |
| 3,656,298 | 4/1972 | Wade | 60/39.65 |
| 3,854,285 | 12/1974 | Stenger et al. | 60/39.66 |

*Primary Examiner*—Carlton R. Croyle
*Assistant Examiner*—Robert E. Garrett
*Attorney, Agent, or Firm*—Henry J. Policinski; Derek P. Lawrence

[57] ABSTRACT

Improved cooling means are provided for cooling a dome assembly associated with a combustor of a gas turbine engine. The improvement is comprised of a dome plate having a generally V-shaped cross section and includes a plurality of passages and channels in the dome plate to provide for the passage of cooling air to effect cooling of both the dome plate and the combustor liner.

5 Claims, 3 Drawing Figures

COMBUSTOR DOME ASSEMBLY HAVING IMPROVED COOLING MEANS

BACKGROUND OF THE INVENTION

This invention relates generally to a gas turbine engine combustor assembly and, more particularly, to an improved mounting and cooling apparatus for a combustor dome assembly.

Combustion, in a gas turbine engine, occurs within a combustion zone defined by a pair of combustor liners extending longitudinally downstream from a dome assembly. Air, introduced into the dome assembly, is mixed with fuel, sprayed into the combustion zone and ignited. Since the dome assembly is immediately adjacent the combustion zone, it is subject to the intense heat produced by the combustion process. As a result, high temperatures can occur in the dome assembly which, if allowed to remain unattended, can cause dome deterioration and limit the operating life of the dome assembly.

To protect the dome assembly from the intense heat of combustion, it is known in the prior art to use a portion of the air introduced into the dome assembly to cool various sections of the dome. It is common practice to utilize louvered joints or cooling holes in the dome to bleed a portion of the air across various sections of the dome to provide a film of cool air which forms a barrier against the heat generated by the combustion process. While many different arrangements of louvers and cooling holes have been employed in prior art combustors, none have been found to be entirely satisfactory.

SUMMARY OF THE INVENTION

It is an object of this invention, therefore, to provide an improved combustor assembly which includes an improved cooling arrangement for prolonging the life of the combustor.

It is another object of this invention to provide an improved dome assembly which includes an improved cooling arrangement for protecting the dome assembly from the high temperature associated with the hot gases of combustion.

Briefly stated, the above and other objects of the present invention, which will become apparent from the following specification and appended drawings, are accomplished by the present invention which provides a dome assembly including an annular dome plate having a generally V-shaped cross section. First and second legs depend from the apex of the V-shaped dome plate and extend upstream therefrom. The apex which is disposed adjacent one of a pair of combustor liners includes a relieved portion forming an open-ended cavity with the combustor liner. The first leg extends upstream from the apex parallel to and in abutting engagement with the combustor liner. The second leg forms with the apex a continuous first surface exposed to the combustion zone and disposed at an acute angle with respect to the combustor liner. A plurality of passages are disposed in the apex substantially at the same acute angle with the liner and extend adjacent the first surface. The passages establish fluid communication between an inlet plenum and the open-ended cavity and are arranged to direct coolant flowing through the passages into the cavity and in impingement on the combustor liner. Removable fastening means are provided for removably fastening the first leg to the combustor liner and are disposed upstream of the apex. The dome plate may also include a lip segment forming part of the relieved portion of the apex. The dome plate may further include a second surface located on the second leg and disposed at the same aforementioned acute angle. The second surface terminates at the passages in the apex whereby coolant flowing in a downstream direction is guided by the second surface into the passages substantially the aforementioned acute angle. A plurality of grooves may be formed in the second leg to provide, in cooperation with the combustor liner, a series of channels communicating the inlet plenum with the cavity.

DESCRIPTION OF THE DRAWINGS

While the specification concludes with a series of claims which particularly point out and distinctly claim the subject matter comprising the present invention, a clear understanding of the invention will be obtained from the following detailed description, which is given in connection with the accompanying drawings, in which:

DESCRIPTION OF A PREFERRED EMBODIMENT

Figures 1, 2, 3:
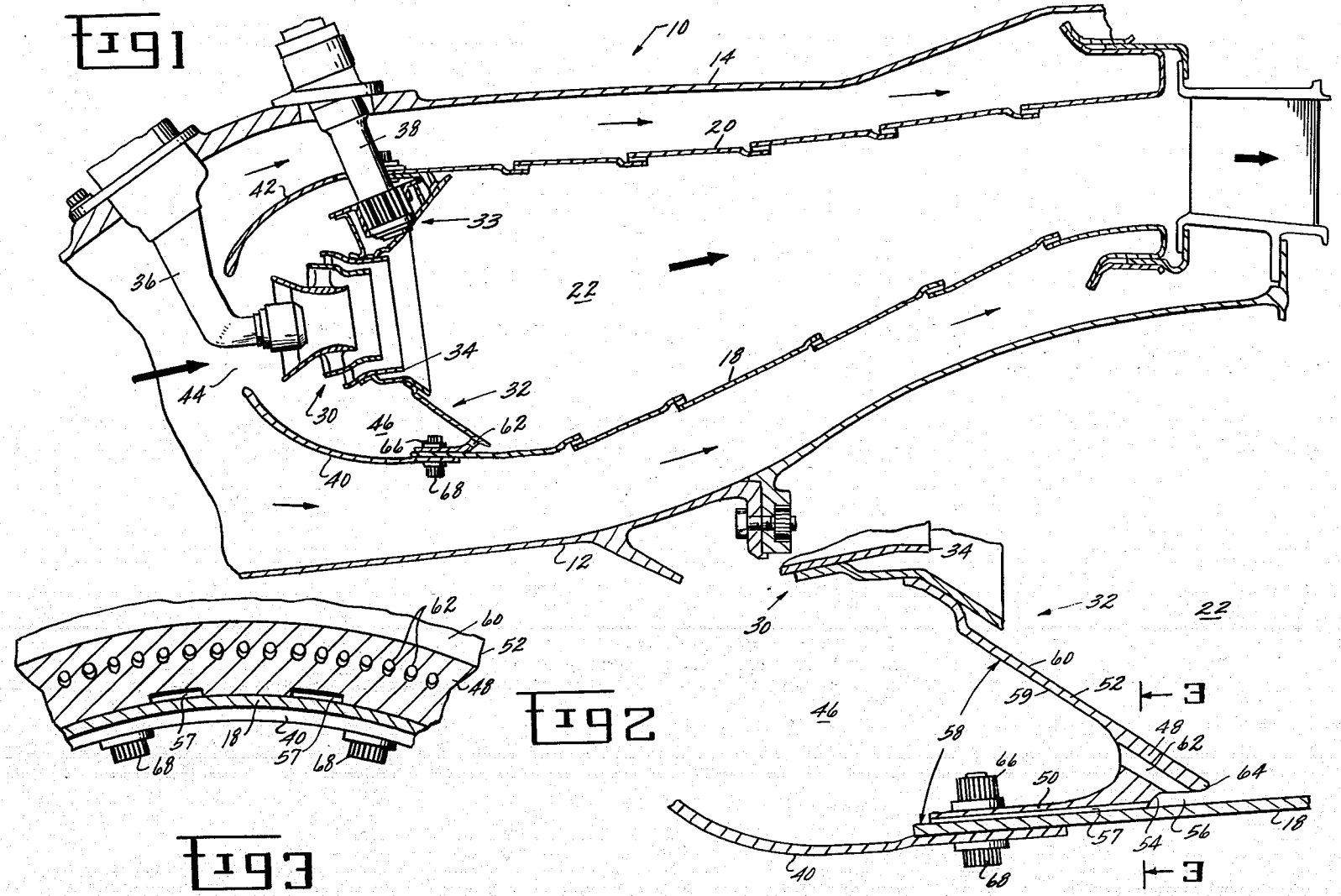
FIG. 1 is a partial, cross-sectional view of the combustion apparatus of a gas turbine engine including the improved cooling arrangement of this invention.
FIG. 2 is an enlarged cross-sectional view of the improved cooling arrangement utilized in the dome assembly of the combustor.
FIG. 3 is an enlarged cross-sectional view of the improved cooling arrangement taken along the line 3 — 3 indicated in FIG. 2.

Referring now to the drawings, attention is directed to FIG. 1 wherein a portion of a gas turbine engine combustor assembly is illustrated in cross section and is generally designated by the numeral 10. The combustor assembly 10 includes axially and circumferentially extending inner and outer combustor casings 12 and 14 respectively which cooperate to define an annular flowpath downstream of a compressor (not shown). A pair of circumferentially and axially extending combustor liners 18 and 20 are positioned between the inner casing 12 and the outer casing 14 in such a manner as to form an annular combustion zone 22. A combustor dome assembly 30 is mounted to the upstream end of the liners 18 and 20 and forms the upstream end of combustion zone 22.

Combustor dome assembly 30 includes a pair of annular dome plates 32 and 33 which are adapted to receive a plurality of fuel/air carbureting devices 34. Fuel nozzle 36 is arranged so as to inject engine fuel into the upstream end of carbureting device 34 wherein the fuel is mixed with combustion air and ejected into the combustion zone 22. Igniter plug 38 protrudes into the combustor 10 through casing 14 and outer liner 20 and is positioned such that its ignition tip is immediately adjacent the downstream end of carbureting device 34. Plug 38 ignites the air/fuel mixture flowing downstream out of carbureting device 34.

A pair of snout rings 40 and 42 are adapted to mount in a manner hereinafter to be described on the combustor liners 18 and 20 respectively and cooperate to form an inlet 44 for entry of combustion air into an inlet plenum 46. A portion of the combustion air entering plenum 46 through inlet 44 is directed into the carbureting device 34 and mixed with fuel as earlier herein set forth. The remaining portion of air entering inlet 44 is adapted for cooling the liners 18 and 20 in a manner now to be described.

To avoid duplication, the following description will be directed only toward dome plate 32. Dome plate 33 is associated with liner 20 in the same manner that dome plate 32 is associated with liner 18. Referring now to FIGS. 2 and 3, it is observed that annular dome plate 32 is exposed on its downstream side to the combustion zone, and hence to the heat released during the combustion process, and on its upstream side to air in inlet plenum 46. Annular dome plate 32 is generally of an integral V-shaped cross section having an apex portion 48 from which first and second leg portions 50, 52 depend, respectively. Apex portion 48 is disposed adjacent to liner 18 and includes a relieved portion 54 which forms, with liner 18, an annular circumferentially open-ended cavity 56 opening into combustion zone 22.

Depending from apex portion 48, leg 50 extends upstream and abuttingly engages liner 18. A plurality of circumferentially spaced grooves 57 extending upstream from cavity 56 are formed in leg 50 to provide, in cooperation with liner 18, a plurality of channels communicating inlet plenum 46 with cavity 56. Leg 52 also depends upstream from apex portion 48 but at an acute angle 58 with liner 18. Leg 52 and apex portion 48 cooperate to form a continuous first surface 60 exposed to the combustion zone 22. Surface 60 is also disposed at acute angle 58 with respect to liner 18.

Air entering inlet plenum 46 is at a temperature much lower than the temperature of the hot gases and may therefore be used to cool the dome plate 32 in a manner now to be described. Cooling air in plenum 46 is directed upon and along a second surface 59 on leg 52 and disposed at the same angle 58 with respect to liner 18. Surface 59 directs cooling air into a plurality of circumferentially spaced passages 62 which are provided in apex portion 48 and which establish a fluid path betweeen inlet plenum 46 and open-ended cavity 56. Passages 62 are arranged in apex portion 48 at the aforementioned angle 58 with respect to liner 18 and lie adjacent first surface 60. Cooling air flowing through passages 62 is directed in a series of streams upon liner 18 to impingement cool liner 18 within cavity 56. Impingement with liner 18 causes the individual streams to deflect and mix with adjacent streams within cavity 56. Tip portion 64 formed at the downstream tip of apex portion 48 serves as a guide to direct the mixed stream of cooling air into combustion zone 22 in a direction substantially along the inner surface of liner 18. The resulting thin film of cooling air serves as a protective barrier between the hot gases of combustion and the inner surface of the liner 18. Additionally, the thin film serves to convectively cool the liner 18.

It should be noted that passages 62 are of small diameter such that cooling air flows through the passages 62 at a high velocity to produce highly efficient convective cooling of apex portion 48 even at its extreme downstream tip. Furthermore, since the passages 62 are disposed at the same acute angle as first surface 60, the passages 62 are separated by a constant distance from surface 60 along their entire length. This feature permits uniform cooling of surface 60 since the metal thickness between the passages 62 and the surface 60 is constant. Uniform cooling prevents localized distortion and thermal cracking which would otherwise occur in apex portion 48 of dome plate 32.

Cooling air in inlet plenum 46 also enters grooves 57, flowing therethrough into cavity 56. Grooves 57 are provided to improve the transient temperature response of liner 18 and leg 50 upstream of apex portion 48 during engine start-up. Since liner 18, leg 50 and cowl 40 are in overlapping cooperation upstream of apex portion 48, the effective thickness of the combustor is greater than at other locations. Hence, under start-up conditions the overlapped location is slow in reaching its steady-state operating temperature, which is essentially the temperature of the air in plenum 46. Slow temperature response may result in the inducement of thermal stresses in the combustor. Grooves 57 permit air in plenum 46 to improve the transient temperature response at the overlapped location through convective heat transfer from the air to liner 18 and leg 50.

A fastening device comprised of nut 66 and bolt 68 secure leg 50 of dome plate 32, liner 18 and snout ring 40 rigidly together at a point upstream of apex portion 48. Location of the fastening device in such a manner removes the device from direct exposure to the hot gases of combustion and also insures that the fastening device will not disrupt the film of cooling air flowing along the inner surface of liner 18.

While a preferred embodiment of the present invention has been described above, it will be readily apparent to those skilled in the art that changes can be made in the structure without departing from the scope of the present invention as set forth in the appended claims.

What is claimed is:

1. In a combustor assembly including a pair of combustor liners radially spaced from one another and adapted to form a combustion zone therebetween, a dome assembly adapted to be positioned between said liners and to cooperate therewith to form the upstream end of said combustion zone, and an inlet cowl adapted to surround said dome assembly and to define an inlet plenum upstream of said combustion zone, the improved dome assembly comprising:

an annular dome plate of generally V-shaped cross section including first and second legs depending from an apex portion of said V-shaped dome plate, said apex portion disposed adjacent one of said pair of liners and downstream of said first and second legs, said dome plate further including a relieved portion in said apex portion between said apex portion and one of said liners, said relieved portion forming with said one of said liners an open-ended cavity opening into said combustion zone, said first leg extending upstream from said apex portion parallel to and in abutting engagement with said one of said liners, said second leg and said apex portion forming a continuous first surface exposed to said combustion zone, said first surface disposed at an acute angle with said one of said pair of liners, a plurality of passages disposed in said apex portion substantially at said acute angle with said one of said liners and extending adjacent said first surface, said passages establishing fluid communication between said inlet plenum and said cavity and further arranged to direct coolant flowing through said passages into said cavity and in impingement on said one of said pair of liners removable fastening means for removably fastening said first leg to said one of said liners said fastening means disposed upstream of said apex portion.

2. The invention as set forth in claim 1 wherein said relieved portion of said apex portion includes a lip segment spaced from said one of said liners and disposed substantially parallel thereto, said lip segment extending downstream from said plurality of passages.

3. The invention as set forth in claim 2 wherein said second leg includes a second surface exposed to coolant flowing in a downstream direction in said inlet plenum and disposed substantially at said acute angle with said one of said liners, said second surface terminating at said passages in said apex portion whereby coolant flowing in a downstream direction is guided by said second surface into said passages substantially at said acute angle.

4. The invention as set forth in claim 3 further comprising channel means between said first leg and said one of said liners, said channel means establishing fluid communication between said inlet plenum and said cavity.

5. The invention as set forth in claim 4 wherein said channel means is comprised of a plurality of circumferentially spaced grooves extending upstream from said cavity to said inlet plenum.

* * * * *